US006141400A

United States Patent [19]

Schardt et al.

[11] Patent Number: 6,141,400

[45] Date of Patent: Oct. 31, 2000

[54] X-RAY SOURCE WHICH EMITS FLUORESCENT X-RAYS

[75] Inventors: Peter Schardt, Roettenbach; Erich Hell; Detlef Mattern, both of Erlangen, all of Germany

[73] Assignee: Siemens Aktiengesellschaft, Munich, Germany

[21] Appl. No.: 09/246,452

[22] Filed: Feb. 9, 1999

[30] Foreign Application Priority Data

Feb. 10, 1998 [DE] Germany ..... 198 05 290
Feb. 27, 1998 [DE] Germany ..... 198 08 342

[51] Int. Cl.[7] ..... H01J 35/08

[52] U.S. Cl. ..... 378/124; 378/119; 378/121; 378/136; 378/143

[58] Field of Search ..... 378/119, 121, 378/124, 134, 136, 140, 143

[56] References Cited

U.S. PATENT DOCUMENTS

| | | | |
|---|---|---|---|
| 2,677,069 | 4/1954 | Bachman | 378/121 |
| 3,383,510 | 5/1968 | Sellers | 378/120 |
| 3,567,928 | 3/1971 | Davies et al. | 378/45 |
| 3,919,548 | 11/1975 | Porter | 378/45 |
| 3,920,999 | 11/1975 | Drexler et al. | 378/119 |
| 4,048,496 | 9/1977 | Albert | 378/45 |
| 4,903,287 | 2/1990 | Harding | 378/119 |
| 5,157,704 | 10/1992 | Harding | 378/119 |
| 5,729,583 | 3/1998 | Tang et al. | 378/122 |
| 5,940,469 | 8/1999 | Hell et al. | 378/143 |

FOREIGN PATENT DOCUMENTS

| | | |
|---|---|---|
| 0 459 567 | 12/1991 | European Pat. Off. . |
| OS 33 26737 | 2/1985 | Germany . |
| OS 37 16618 | 12/1988 | Germany . |
| OS 196 39 241 | 4/1998 | Germany . |
| OS 196 39 243 | 4/1998 | Germany . |
| 1 443 048 | 7/1976 | United Kingdom . |

*Primary Examiner*—David P. Porta
*Assistant Examiner*—Allen C Ho
*Attorney, Agent, or Firm*—Hill & Simpson

[57] ABSTRACT

A fluorescent X-ray emitting source has an unfocused, omni-directionally radiating electron source and an anode target for the generation of X-ray bremsstrahlung, which releases mono-energetic X-rays in a fluorescent target. The electron source and the fluorescent target are arranged in a vacuum housing with an X-ray exit window. The housing has an interior wall surface forming the anode target and the fluorescent target is aligned with the X-ray exit window.

19 Claims, 4 Drawing Sheets

X-RAY SOURCE WHICH EMITS FLUORESCENT X-RAYS

BACKGROUND OF THE INVENTION

1. Field of the Invention

The present invention relates to an X-ray source which emits fluorescent X-rays of the type having an electron source and an anode target for the generation of X-ray bremsstrahlung, which produces mono-energetic X-radiation upon striking a fluorescent target.

2. Description of the Prior Art

An X-ray source is described in German OS 33 26 737 for the generation of fluorescent X-rays of different radiation spectra, in which an annular primary source, such as an americium radiator is provided in the cover of a housing, opposite a number cf fluorescent targets. A fluorescent target carrier plate carries the fluorescent targets, which are respectively composed of a variety of materials. Substantially mono-energetic fluorescent X-radiation is released by radiation from the primary source striking a selected, oppositely arranged fluorescent target. The fluorescent rays exit through a bore in the center of the primary source in the cover of the housing. Such a fluorescent X-ray emitting source is constructed very compactly, which accommodates common applications, but it cannot deliver a high flow of X-rays, since the activity of the primary source is typically at 10 mCi, nor can it be switched off, since the primary source constantly radiates. In addition, due to the continuously radiating (radioactive) primary source, it also must be cleared of radioactive waste, which is expensive. There are even considerable expenses in the transport of such fluorescent X-ray emitting sources, for reasons of safety.

There are also known deactivatable fluorescent X-ray emitting sources. Deactivability is achieved by using a deactivatable electron source, for example, a thermionic cathode supplied with a heating current that can be interrupted. Such fluorescent X-ray emitting sources are thus problematic, because he conversion of the electron energy into X-ray bremsstrahlung, and the subsequent conversion of X-ray bremsstrahlung into fluorescent X-radiation, each occur with only a low degree of efficiency. The first degree of efficiency equals approximately 1%; the second depends basically on the geometry of the arrangement. In order to achieve the image quality that is achieved with conventional X-ray tubes (the Detective Quantum Efficiency (DQE) is a significant parameter here), the electrical power would have to be increased to at least 10 times the electrical power common today, which is practically out of the question in practice.

In known fluorescent X-ray emitting sources of the abovementioned type, either the electrons which are generated by a cathode that is located in a focusing head are focused directly onto a fluorescent target, which naturally limits the electric power, or the electrons are accelerated onto one part of the housing of the X-ray source, where they generate bremsstrahlung, which then strikes the fluorescent target at a solid angle prescribed by the geometry of the arrangement, and generates fluorescent X-rays at this target (cf. European Application 0 459 567, German OS 37 16 618 and German OS 196 39 241). The previously mentioned problem of a low degree of efficiency arises in these devices as well, and so, to the extent that acceptable dimensions are maintained, only an unsatisfactory image quality can be achieved with fluorescent X-ray emitting sources of the abovementioned type. In the fluorescent X-ray emitting sources described in German OS 37 16 618 and German OS 196 39 24 cited above, a cone-shaped fluorescent target is used, which is irradiated by X-ray bremsstrahlung that is released by electrons from a focused electron source striking an anode target, so that the characteristic mono-energetic fluorescent X-radiation is released in the anode target.

Furthermore, in German OS 196 39 243 a fluorescent X-ray source with N different targets is described, which irradiates the different fluorescent targets with bremsstrahlung such that an electrical target changeover is possible. Aside from the fact that a number of focused electron sources is necessary for this, only 1/N of the maximum electrical power which is possible from the anode side is used.

SUMMARY OF THE INVENTION

An object of the present invention is to provide a fluorescent X-ray emitting source of the abovementioned type that has a greater degree of efficiency than conventional apparatuses.

This object is achieved in accordance with the invention in a fluorescent X-ray emitting source having an unfocused omni-directionally radiating electron source and a fluorescent target arranged in a vacuum housing with a radiation window, and an anode target which preferably forms the entire interior surface of the housing, with the fluorescent target being oriented to the X-ray exit window.

In the inventive X-ray source, practically the whole interior of the vacuum housing is constructed as an anode target and is preferably cooled, so that a simple, unfocused, omni-directionally radiating and thus powerful electron source can be utilized as a cathode. The electron optics preferably consists only of the cathode, which is preferably constructed as a heatable cylindrical wire filament, and the interior of the vacuum housing, which serves as an anode.

The cathode evenly irradiates essentially the entire interior of the vacuum housing with electrons, resulting in a very high yield in the generation of the X-ray bremsstrahlung, given the simplest construction. This yield is then converted in the fluorescent target for the generation of the mono-energetic fluorescent X-radiation.

The inventive fluorescent X-ray emitting source can be deactivated; which enables a high flow of fluorescent X-ray photons while still retaining the advantages of a small, compact construction and thus allowing uncomplicated use, independent of location. The inventive source does not need to be laboriously cleared of radioactive waste, and it can be transported without complications, since there is no continuously active radiator. It is important for the high flow of fluorescent X-ray photons that the entire interior of the vacuum housing, which functions as the anode target, be evenly irradiated with electrons by the unfocused, omni-directionally radiating electron source, so that a high flow of bremsstrahlung photons is available for the excitation of the fluorescent target.

In the inventive fluorescent X-ray emitting source, the substantially mono-energetic fluorescent X-radiation does not necessarily emanate from a focal spot. For many applications, however, such as X-ray analysis, this does not represent a disadvantage.

Dependent on the particular use of the fluorescent X-ray emitting source, a conical projection or mandrel for the generation of a defined focal spot, such as described in the aforementioned European Application 459 567 or United Kingdom Specification 1 443 048, serves as fluorescent target. If a focal spot is not necessary cr not desirable, then a flat, solid target serves as the fluorescent target, which can either be arranged in the housing, on the side opposite the X-ray exit window, or cutside the housing in front of the X-ray exit window. The X-ray exit window consists of a thin material of a low atomic number, e.g. of a 0.3 mm thick beryllium plate.

In an embodiment of the invention, in the interest of a simple construction, the vacuum housing is constructed generally cylindrically, with an X-ray exit window in a face wall, with the electron source concentrically surrounding the fluorescent target, which is situated inside the vacuum housing substantially on the center axis of the vacuum housing.

In another embodiment of the invention, in order to be able to generate fluorescent X-rays of different radiation spectra, various fluorescent targets can be inserted into the beam path of the X-ray bremsstrahlung, these targets being arranged on an adjustable, i.e. displaceable or rotatable, carrier plate. The carrier plate can be arranged outside the vacuum housing in front of the X-ray exit window. It is also possible to arrange the carrier plate inside the vacuum housing, opposite the X-ray exit window. In this case, according to one version of the invention, the vacuum housing can have a housing projection in which the carrier plate is rotatably arranged such that only one target is located in the path of the X-ray bremsstrahlung. To avoid expensive vacuum-tight feed-through connections in the housing wall, the carrier plate can be coupled, by magnetic coupling, with an adjusting element disposed outside the vacuum housing. In the simplest case, the rotating drive can be of a bar magnet at the carrier plate and a parallel bar magnet outside the vacuum housing. When the external bar magnet is rotated, it moves the internal magnet with it, rotating the fluorescent target carrier plate.

The anode target of the inventive fluorescent X-ray emitting source is formed in known fashion by a layer containing material of high atomic number, such as tungsten.

The degree of effectiveness in the conversion of the X-ray bremsstrahlung into the flourescent X-rays of the fluorescent target can be increased in known fashion by, under the layer that forms the anode target, providing the interior face of the vacuum housing with a Compton scattering layer consisting of a material of a low atomic number, preferably aluminum or beryllium. The entire vacuum housing can be formed of the material of the Compton scattering layer. The presence of a Compton scattering layer affords the possibility of reflection and/or multiple reflections of the X-ray bremsstrahlung, so that more X-ray bremsstrahlung reaches the fluorescent target, resulting in an increase of the overall degree of efficiency.

According to a version of the invention, the interior of the vacuum housing, which supports the anode target, can contain channels which are traversed by a coolant, so that the, cooling which is necessary in the case of the utilization of an unfocused and thus large and powerful, electron source is guaranteed.

The achievable activity per kilowatt of built-in electrical power is around several hundred mCi/kW with a large-surface target. Assuming a power density in stationary anodes of 200 W/mm$^2$ to 300 W/mm$^2$ with splash-water cooling, for example, very high activities can be generated with the smallest anode geometries.

DESCRIPTION OF THE PREFERRED EMBODIMENTS

Figure 1:
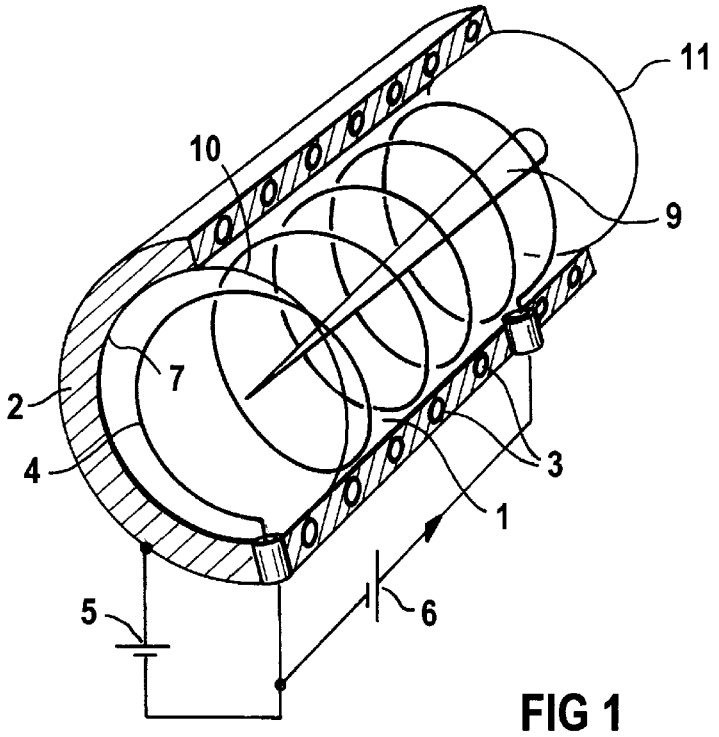
FIG. 1 is a schematic perspective view, partly in section, of an inventive fluorescent X-ray emitting source.

In the inventive fluorescent X-ray emitting source according to FIG. 1, substantially the entire interior 1 of an approximately cylindrical housing wall 2 of the vacuum housing forms an anode target. The housing wall 2 contains cooling channels 3 which are traversed by a liquid or gaseous coolant.

The electron optics of the fluorescent X-ray source comprise only one cathode 4—with an electron source, which is constructed of wire as a cylinder filament and which radiates unfocused electrons in all directions—and the interior 1 of the housing wall 2.

The acceleration of the electrodes exiting from the cathode 4, which can be heated by means of a heating voltage source 6, onto the interior 1 of the housing wall 2 ensues by means of an acceleration voltage source 5.

The interior 1 of the housing wall 2, which acts as an anode target, is preferably provided with an anode material 7 (which consists of a tungsten layer in the exemplary embodiment according to FIG. 1), preferably over the entire surface of the housing wall, or at least on a region surrounding the cathode 4. X-ray bremsstrahlung emanates from this anode material, given the incidence of electrons thereon.

Figure 2:
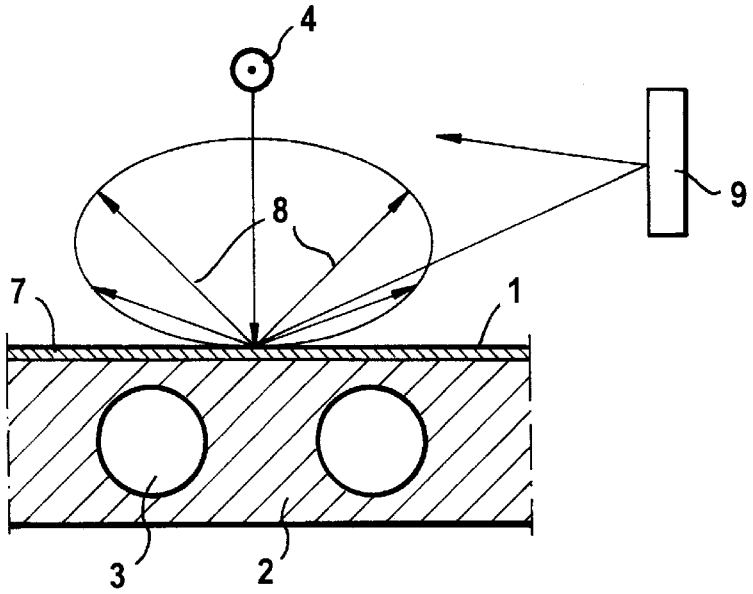
FIG. 2 is an enlarged section through a part of the wall of the vacuum housing of another embodiment of an inventive fluorescent X-ray emitting source.

In the exemplary embodiments according to FIGS. 1 and 2, a Compton scattering layer is arranged under the anode material 7, this layer being formed by the beryllium or aluminum housing wall 2 in these exemplary embodiments. Alternatively, a special Compton scattering layer made of a suitable material can be provided between the anode material 7 and the housing wall 2, such as is the case in the exemplary embodiment according to FIG. 3 (described below).

As shown in FIG. 2, the electrons emanating from the cathode 4 are accelerated onto the tungsten layer provided as the anode material 7, and thus produce X-ray bremsstrahlung 8, which is radiated outwardly into a solid angle and which strikes a fluorescent target, possibly after one or more reflections at the Compton scattering layer.

In the exemplary embodiment according to FIG. 1, the fluorescent target 9 is constructed as a conical projection which is attached to a face wall 11 of the vacuum housing, inside the vacuum housing and surrounded by the cylinder filament. The center axes of the vacuum housing, the cylinder filament, and the fluorescent target 9 substantially coincide, so that there is a concentric arrangement. The fluorescent X-rays emanating from the fluorescent target exit from the vacuum housing through an X-ray exit window 10, which is arranged in the vacuum housing in the face wall 12, which is opposite the face wall 11.

In the exemplary embodiment according to FIG. 2, instead of a projection, the fluorescent target 9 is a flat expanded solid target, which is arranged opposite an X-ray exit window (not depicted in FIG. 2).

Figure 3:
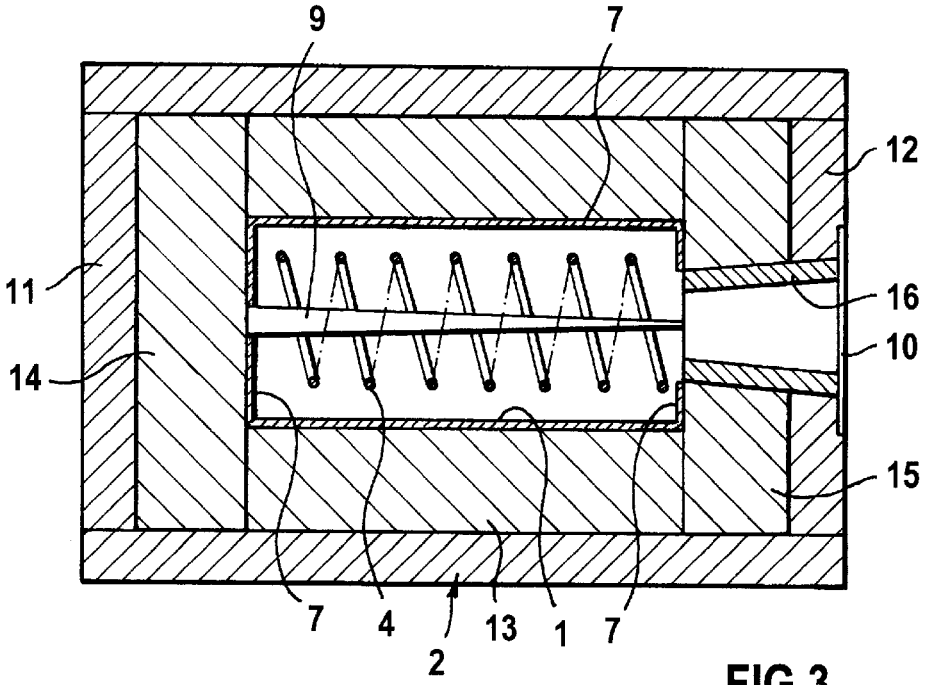
FIG. 3 is a longitudinal section through another embodiment of an inventive fluorescent X-ray emitting source.

The inventive fluorescent X-ray emitting source according to FIG. 3 has a vacuum housing with two face walls 11 and 12 in addition to the approximately cylindrical housing wall 2. The entire interior of the vacuum housing is provided with a Compton scattering layer, which consists of aluminum or beryllium, for example, and which is composed of sections 13, 14 and 15. A layer of an anode material such as tungsten is arranged on the Compton scattering layer, covering the entire interior surface thereof. A fluorescent target 9, which is constructed as a conical projection arranged concentrically on the longitudinal axis of the vacuum housing, is surrounded by a cathode 4, which is constructed as a cylinder filament and which extends practically the entire length of the interior of the vacuum housing and of the fluorescent target 9, so that the entire interior surface of the vacuum housing which is active as an anode target, and particularly the cylindrical region surrounding the cathode 4, is consequently evenly irradiated with electrons, for the generation of X-ray bremsstrahlung. The mono-energetic fluorescent X-rays emanating from the fluorescent target 9 under the effect of the X-ray bremsstrahlung exit through the X-ray exit window 10, which consists of beryllium, for example and which is surrounded by a collimator 16.

The fluorescent target 9 of the according to FIG. 3, which is constructed as a conical projection, can be replaced by a flatly expanded solid fluorescent target 9, as is depicted in the exemplary embodiment according to FIG. 2. The flat target 9 should then be arranged centrally on the section 14 of the Compton scattering layer.

Figure 4:
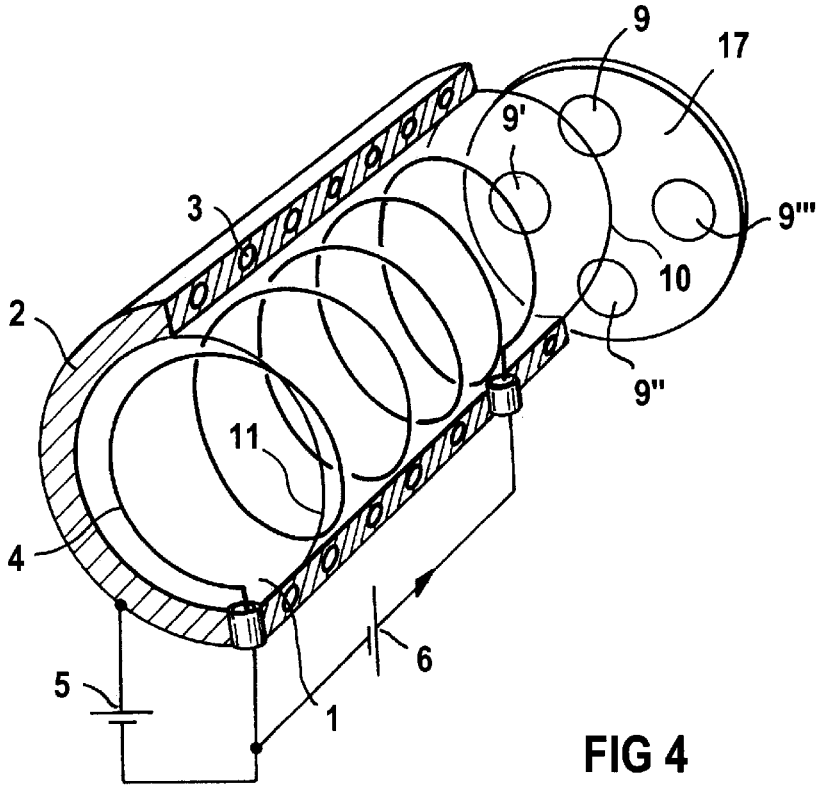
FIG. 4 shows another version of an inventive fluorescent X-ray emitting source, which allows the generation of fluorescent X-rays of various radiation spectra, depicted analogously to FIG. 1.

The fluorescent X-ray emitting source according to FIG. 4 differs from that according to FIG. 1 in that a number of fluorescent targets are provided outside the vacuum housing, rather than just a single fluorescent target. These fluorescent targets 9, 9', 9", 9'" are constructed flat and solid, are made of different materials, and are arranged on an adjustable, namely rotatable, carrier plate 17. The X-ray bremsstrahlung which arises given the striking of the tungsten layer, which is provided as anode material 7, with electrons exits from the vacuum housing through the X-ray exit window 10, possibly subsequent to reflection(s) at the Compton scattering layer, and the bremsstrahlung strikes a selected one of the fluorescent targets 9, 9', 9", 9'".

Figure 5:
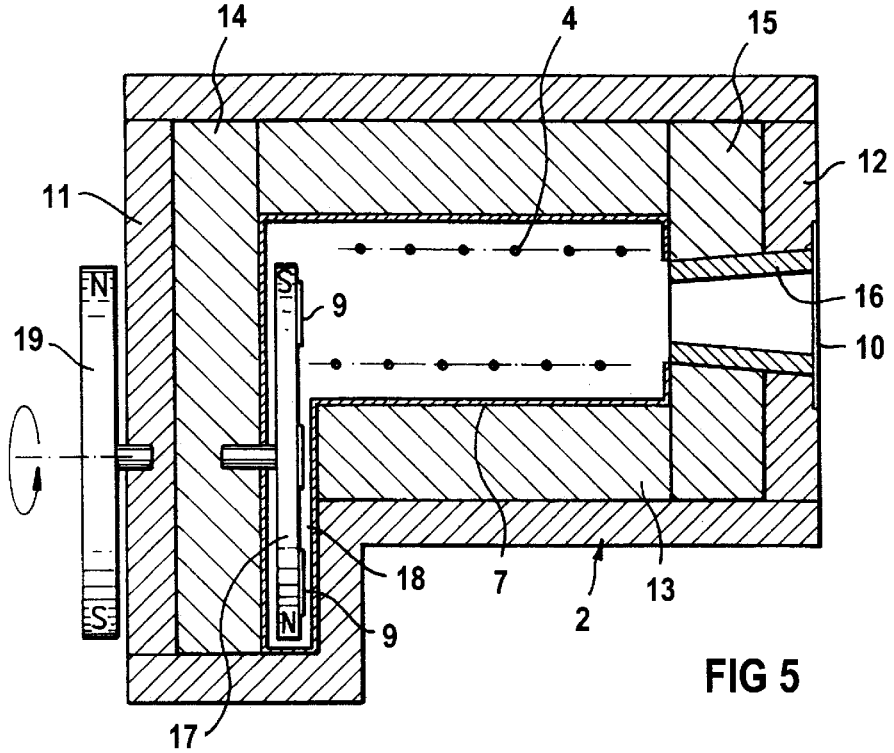
FIG. 5 shows another embodiment of an inventive fluorescent X-ray source, which also allows the generation of fluorescent X-radiation of different radiation spectra, depicted analogously to FIG. 3.

The carrier plate 17 with the fluorescent targets 9,9',9",9'" need not be arranged outside the vacuum housing, but instead can be located inside the vacuum housing, as in the exemplifying embodiment according to FIG. 5.

In the exemplary embodiment according to FIG. 5, which largely corresponds to the exemplary embodiment according to FIG. 3, instead of a projection fluorescent target, the carrier plate 17 with the fluorescent targets 9,9',9",9'" is rotatably arranged in a housing projection 18 of the otherwise substantially cylindrical vacuum housing. The arrangement is such that only one of the fluorescent targets 9,9',9", 9'" always projects at a time into the cylindrical interior space of the vacuum housing, i.e. in the region in which X-ray bremsstrahlung disperses. The fluorescent X-rays emanating from the particular fluorescent target which is currently located in the working position (the fluorescent target 9 in the operating mode depicted in FIG. 5) exits through the X-ray exit window 10, which consists of beryllium, for example.

The carrier plate 17 is constructed as a permanent magnet 17, or is assembled from a number of permanent magnets, so that an adjustment of the carrier plate 17 can be made using an adjusting element 19, likewise magnetic, which is rotatably arranged outside the housing, without necessitating a vacuum-tight feed-through of a connection between the adjusting element 19 and the carrier plate 17 through the wall of the housing.

Figure 7:
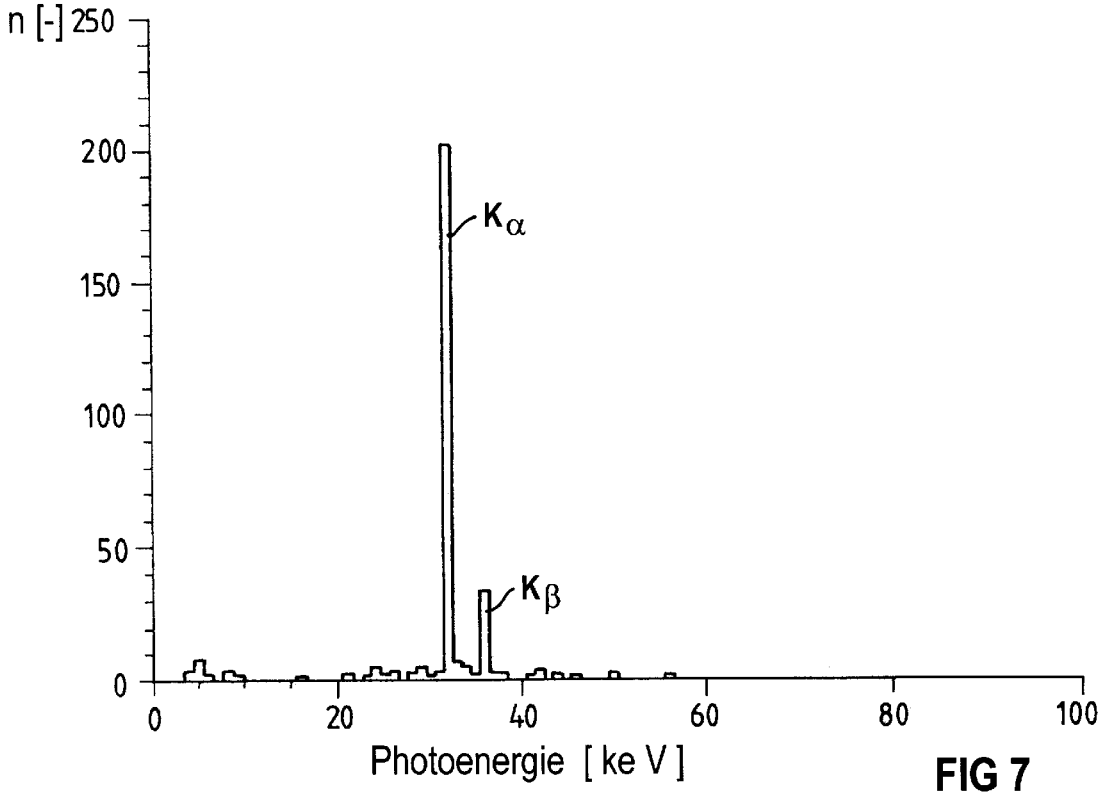
FIG. 7 is a fluorescent spectrum for tungsten as an anode material, in connection with a fluorescent target made of barium.
Figure 6:
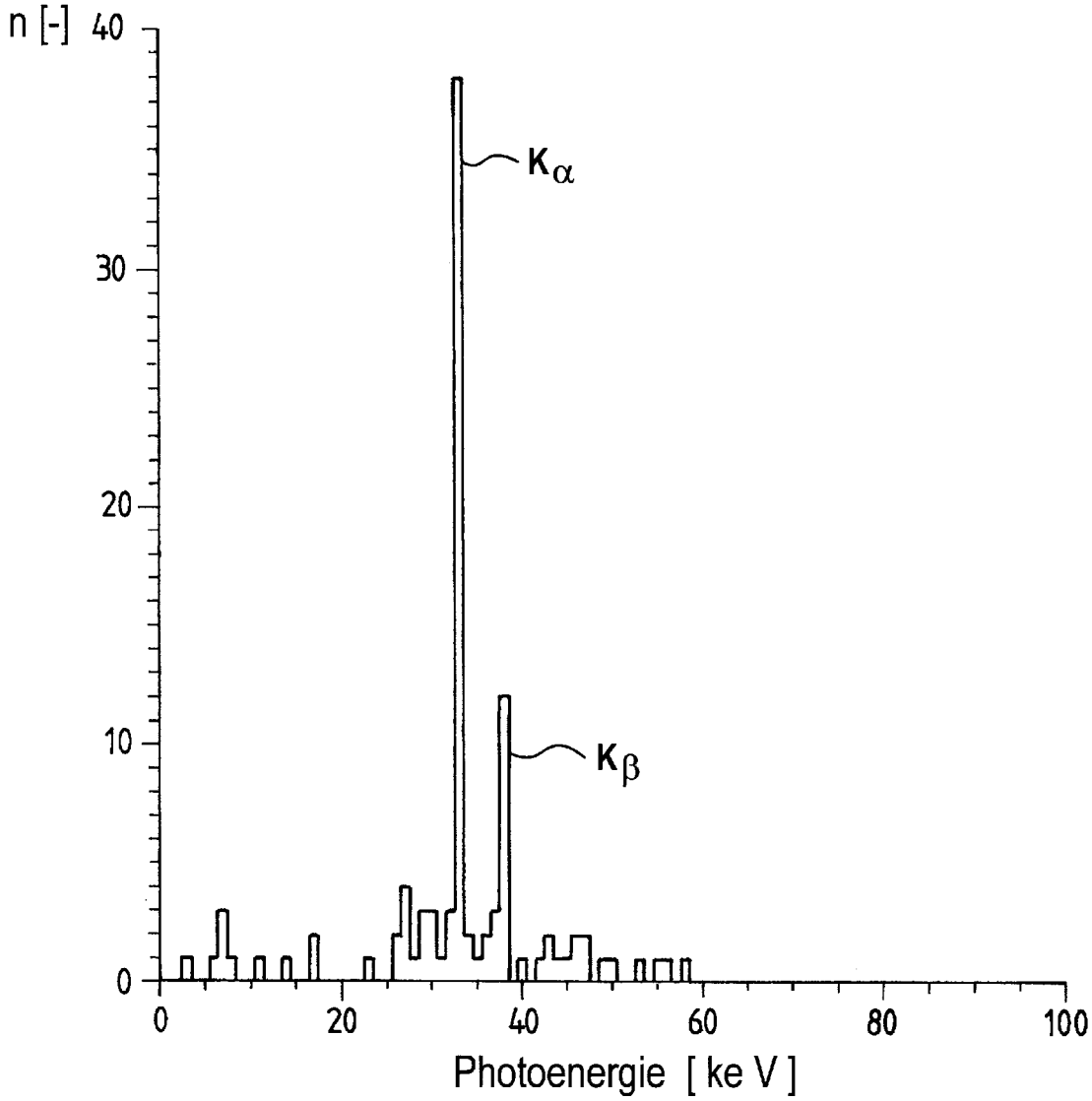
FIG. 6 is a fluorescent spectrum for tungsten as an anode material, in connection with a fluorescent target made of lanthanum.

Simulated examples of radiation spectra which can be achieved using tungsten as the anode material 7 (the relative number n of fluorescent X-ray photons is therein plotted in relation to the energy of the fluorescent X-ray photons in keV) are depicted in FIGS. 6 and 7 and demonstrate that substantially mono-energetic fluorescent X-rays are in fact generated. FIG. 6 depicts the radiation spectrum for a fluorescent target made of lanthanum, and FIG. 7 depicts that for a fluorescent target made of barium. If the spectral portions below and/or above the fluorescence lines $K_\alpha$ and $K_\beta$ are undesirable, they can be filtered out with suitable filters, for example, which can be connected upstream of the X-ray exit window 10, as needed.

The selection of the material of the X-ray exit window 10 depends on whether the X-ray bremsstrahlung is intended to exit and reach a fluorescent target arranged outside the vacuum housing, or, as in the exemplary embodiments according to FIG. 3 and FIG. 5, the characteristic fluorescent X-rays are intended to exit.

The invention is not limited to the depicted exemplary embodiments. Besides the possibility, unlike in the exemplary embodiments according to FIG. 3 and FIG. 5, of decoupling the X-ray bremsstrahlung via the X-ray exit window 10 and the upstream collimator 16, and directing it to a fluorescent target arranged outside the vacuum housing (i.e. arranging the fluorescent target carrier plate 17 in front of the X-ray exit window 10 and to the right, in the FIGS. 3 and 5), the design can be such that an additional X-ray exit window is provided on the side of the vacuum housing opposite the X.-ray exit window 10, so that the fluorescent X-rays can exit through this additional X-ray exit window after traveling through the right X-ray exit window 10 and the interior of the vacuum housing.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray source comprising:

a vacuum housing having an interior wall;

an anode target on said interior wall, said interior wall being comprised substantially entirely of said anode target;

an electron source disposed inside said vacuum housing which radiates unfocused electrons in all directions, said electrons striking said anode target and generating X-ray bremsstrahlung; and a fluorescent target, disposed in a path of said X-ray bremsstrahlung, which emits mono-energetic fluorescent X-rays upon being struck by said X-ray bremsstrahlung.

2. An X-ray source as claimed in claim 1 wherein said electron source comprises a heatable wire filament.

3. An X-ray source as claimed in claim 1 wherein said vacuum housing comprises a substantially cylindrical housing having a center axis and opposite end faces and an X-ray exit window, said X-ray exit window being disposed in one of said end faces, wherein said fluorescent target is disposed inside said vacuum housing substantially on said center axis, and wherein said electron source concentrically surrounds said fluorescent target.

4. An X-ray source as claimed in claim 1 wherein said fluorescent target comprises a first fluorescent target, and further comprising a plurality of additional fluorescent targets, said first fluorescent target and said plurality of additional fluorescent targets having respectively different radiation spectra, and a movable carrier plate on which said first fluorescent target and said plurality of additional fluorescent targets are mounted, for disposing one of said fluorescent targets at a time in said path of said X-ray bremsstrahlung.

5. An X-ray source as claimed in claim 4 wherein said vacuum housing has an X-ray exit window and wherein said carrier plate is disposed outside of said vacuum housing in front of said X-ray exit window.

6. An X-ray source as claimed in claim 4 wherein said vacuum housing has an X-ray exit window and wherein said carrier plate is disposed inside said vacuum housing opposite said X-ray exit window.

7. An X-ray source as claimed in claim 6 wherein said vacuum housing comprises a housing projection on which said carrier plate is rotatably mounted.

8. An X-ray source as claimed in claim 6 wherein said carrier plate has a magnetized portion, and further comprising a movable magnetic adjusting element disposed outside of said vacuum housing, magnetically coupled to said magnetic portion of said carrier plate, for moving said carrier plate inside said vacuum housing as said magnetic adjusting element is moved outside of said vacuum housing.

9. An X-ray source as claimed in claim 1 wherein said vacuum housing comprises a substantially cylindrical housing having opposite end faces, and a radiation exit window disposed in one of said opposite end faces.

10. An X-ray source as claimed in claim 9 wherein said vacuum housing has a center axis, and wherein said electron source comprises a heatable wire filament concentrically disposed around said center axis.

11. An X-ray source as claimed in claim 1 wherein said anode target comprises a layer on a surface of said interior of said vacuum housing, said layer containing material having a high atomic number.

12. An X-ray source as claimed in claim 11 further comprising a Compton scattering layer on said interior of said vacuum housing below said layer forming said anode target.

13. An X-ray source as claimed in claim 12 wherein said Compton scattering layer comprises material having a low atomic number.

14. An X-ray source as claimed in claim 13 wherein said Compton scattering layer comprises a material selected from the group consisting of aluminum and beryllium.

15. An X-ray source as claimed in claim 12 wherein said vacuum housing is comprised of material forming said Compton scattering layer.

16. An X-ray source as claimed in claim 11 wherein said layer forming said anode target comprises a tungsten layer.

17. An X-ray source as claimed in claim 1 wherein said vacuum housing has a housing wall forming said interior, and further comprising a plurality of channels in said housing wall with a coolant flowing in said plurality of channels.

18. An X-ray source as claimed in claim 1 wherein said vacuum housing has an X-ray exit window, and wherein said fluorescent target is disposed inside said vacuum housing and said mono-energetic fluorescent X-rays exit said vacuum housing through said X-ray exit window.

19. An X-ray source as claimed in claim 1 wherein said vacuum housing has an X-ray exit window, and wherein said fluorescent target is disposed outside of said vacuum housing and wherein said X-ray bremsstrahlung exits said vacuum housing through said X-ray exit window for striking said fluorescent target.

* * * * *